US005683190A

United States Patent [19]

Gawler

[11] Patent Number: 5,683,190

[45] Date of Patent: Nov. 4, 1997

[54] FRANKING APPARATUS AND MAIL TRANSPORT THEREOF

[75] Inventor: David Anthony Gawler, Brentwood, United Kingdom

[73] Assignee: Neopost Limited, Essex, United Kingdom

[21] Appl. No.: 590,365

[22] Filed: Jan. 25, 1996

[30] Foreign Application Priority Data

Jan. 30, 1995 [GB] United Kingdom ..... 9501730

[51] Int. Cl.[6] ..... B41J 13/00

[52] U.S. Cl. ..... 400/582; 400/596; 400/708

[58] Field of Search ..... 400/582, 120.01, 400/708, 596, 625, 624, 636; 364/464.02

[56] References Cited

U.S. PATENT DOCUMENTS

| | | | |
|---|---|---|---|
| 3,734,011 | 5/1973 | Williams . | |
| 5,325,114 | 6/1994 | Fogle et al. | 400/582 |
| 5,350,245 | 9/1994 | Gallagher | 400/582 |
| 5,471,928 | 12/1995 | Dimur et al. | 400/582 |

FOREIGN PATENT DOCUMENTS

| | | |
|---|---|---|
| 0180911 | 10/1985 | European Pat. Off. . |
| 0257527 | 8/1987 | European Pat. Off. . |
| 0585676 | 8/1993 | European Pat. Off. . |
| 3264430 | 11/1991 | Japan . |

*Primary Examiner*—John S. Hilten

*Attorney, Agent, or Firm*—Shoemaker and Mattare, Ltd.

[57] ABSTRACT

A mail transport for a franking machine is disclosed in which mail is fed toward a printing head by input rollers, is fed past the printing head by an impression roller and is ejected from the franking machine by ejection rollers. Drive to the input rollers is controlled to initially feed the mail at a transit speed toward the print head, to feed the mail item at a printing speed, during a printing period, lower than the transit speed and initially in an ejection period after the printing period to feed the mail item at the transit speed. When the mail item is released from the input rollers, the ejection rollers are driven to feed the mail item at a higher speed than the transit speed.

10 Claims, 2 Drawing Sheets

FRANKING APPARATUS AND MAIL TRANSPORT THEREOF

BACKGROUND OF THE INVENTION

This invention relates to franking machines and to means for transporting mail items through the franking machine.

Franking machines include accounting and control means usually comprising a microprocessor operable to carry out accounting in respect of values of postage charges to be printed on mail item and to decrement a stored value of credit by an amount equal to the value of the postage charge. The microprocessor controls operation of feed means to feed the mail item past a print head and at the same time controls the print head to print a franking impression on the mail item, the franking impression including an indication of the value of the postage charge in respect of that mail item. Previously the print head has been implemented as a rotatable print drum carrying print dies and print wheels, the print dies being utilised to print an invariable part of the franking impression, and a slogan if desired, and the print wheels being settable to print variable parts of the impression comprising the value of postage charge and date. More recently it has been proposed to used a thermal print head to print the franking impression and slogan. The thermal print head includes a plurality of thermal printing elements disposed in a line extending transversely to the direction of feed of the mail item. A thermal transfer ink ribbon is interposed between the thermal printing elements and the mail item with an ink layer of the ribbon in contact with the mail item. As the mail item is fed by the feeding means past the line of thermal printing elements, the contact between the ribbon and the mail item causes the ribbon to adhere to the mail item and thereby to be drawn with mail item past the print head. The thermal printing elements are selectively energised by the control means in each of a plurality of printing cycles so as, in each printing cycle, to heat areas of the ink layer to cause transfer of ink from those areas to the mail item to form dots printed at selected positions on the mail item. Repeated selection and energisation of selected thermal printing elements in a series of printing cycles causes printing of dots to form a required printed impression in a line by line manner on the mail item.

In order to achieve reliable high quality printing on mail items when using thermal transfer ink printing, the speed at which the mail item is fed past the thermal printing elements of the print head is chosen to be an optimum or as close as practical to an optimum for the print technology and the specific print head used. However it is desired to maintain the time taken for feeding a mail item through the franking machine as short as is practicable.

SUMMARY OF THE INVENTION

According to the invention a mail transport for a franking machine includes a pair of input rollers rotatable to feed a mail item into the franking machine; a pair of ejection rollers rotatable to eject the mail item from the franking machine; a rotatable impression roller located intermediate said input and ejection rollers for pressing a mail item and thermal transfer ink ribbon into printing engagement with thermal printing elements of a thermal print head; first drive means operable to rotate the input rollers; second drive means operable to rotate the ejection rollers; control means operative to operate the first drive means in an input period to feed the mail item at a transit speed toward the print head; to operate the first drive means in a printing period during which the mail item is engaged between the impression roller and the print head to feed the mail item at a printing speed lower than said transit speed and to operate the first drive means in a first ejection period subsequent to completion of the printing period to feed the mail item at said transit speed.

BRIEF DESCRIPTION OF THE DRAWING

An embodiment of the invention will be described hereinafter by way of example with reference to the drawings in which.

DESCRIPTION OF THE PREFERRED EMBODIMENT

Figure 1:
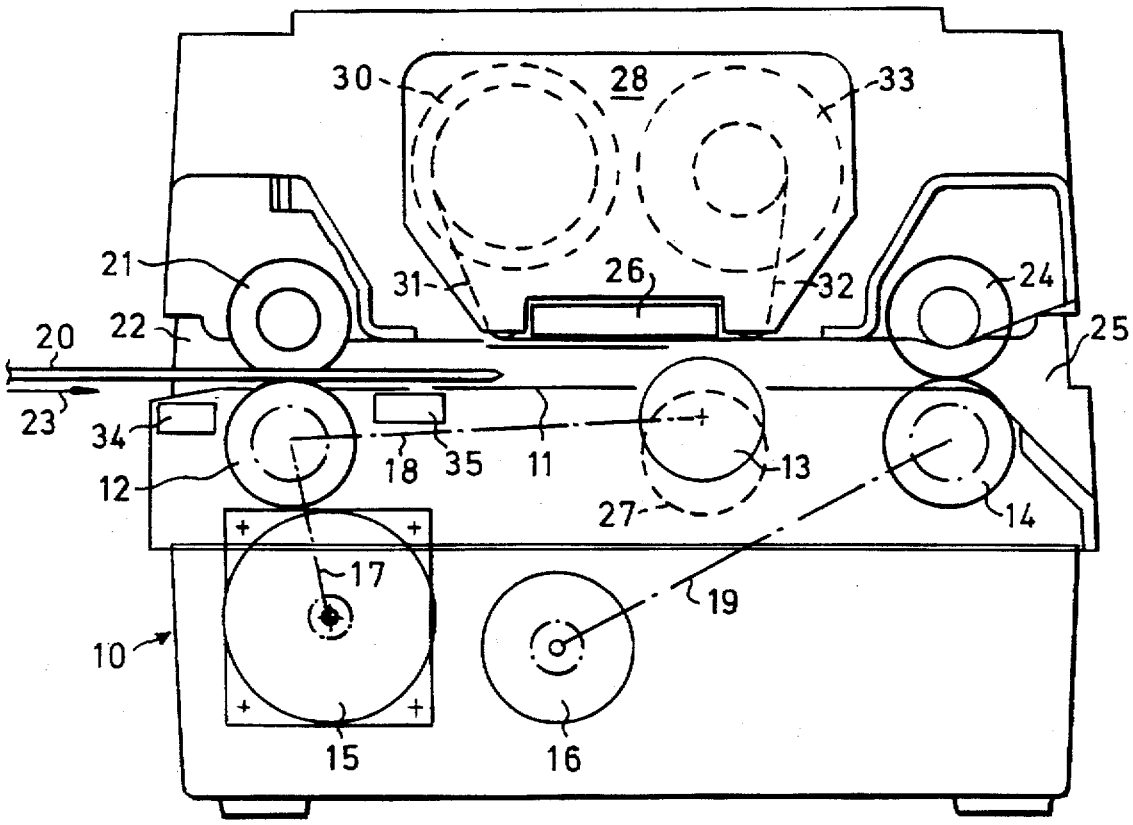
FIG. 1 illustrates a construction of means for feeding a mail item and a thermal transfer ink ribbon past a thermal print head of a franking machine.

Referring first to FIG. 1, a franking machine includes a housing and chassis 10 having a feed bed 11 extending horizontally therethrough and in which a first input roller 12, an impression roller 13 and a first ejection roller 14 are mounted. The first input roller 12 and impression roller 13 are rotated by means of a main motor 15 through first drive means indicated by broken lines 17 and 18 respectively and the first ejection roller 14 is driven by an ejection drive motor 16 through second drive transmission means indicated by broken lines 19. The angular speeds of rotation of the input roller 12 and impression roller 13 are such that peripheral speeds of the input roller and impression roller are equal. The first input roller 12 and the first ejection roller 14 extend through apertures in the feed bed 11 such that the peripheral surfaces of these rollers project slightly above the feed bed so as to engage mail items 20 to be fed along the feed bed 11. A second input roller 21, which is freely rotatable, is mounted above the first input roller 12 and is resiliently urged toward the first drive roller.

The input rollers 12 and 21 together form a nip to resiliently engage and receive therebetween the mail item 20 when inserted at entry 22 to the feed bed 11 and to feed the mail item in the direction of arrow 23 into the franking machine along the feed bed 11. A second ejection roller 24, which is freely rotatable, is mounted above the first ejection roller 14 and is resiliently urged toward the first ejection roller 14. The ejection rollers 14 and 24 together form a nip to resiliently engage and receive therebetween the mail item 20 to eject the mail item through an exit 25 from the franking machine. A thermal print head 26 is mounted in spaced relationship with the feed bed 11. The print head 26 has a plurality of thermal printing elements disposed along a line extending in a direction transverse to the direction, indicated by arrow 23, of feeding of the mail item. The line of thermal printing elements is parallel to the axis of rotation of the impression roller and the thermal printing elements are disposed in opposition to the peripheral surface of the impression roller 13. The impression roller is mounted in a cradle (not shown) whereby the impression roller can be moved by a cradle motor 62 (FIG. 2) into an operative position as shown in FIG. 1 from an inoperative position, indicated by broken line 27, and returned to the inoperative position. In the operative position the impression roller extends through an aperture in the feed bed so as to project from the feed bed and is resiliently urged toward the print head 26. In the inoperative position the impression roller is retracted such that it is spaced from the print head 26 to permit mail items to pass freely between the impression roller and the print head. For example, the impression roller, when in the retracted inoperative position, may lie below the surface of the feed bed 11. A first mail item sensor 34 is located at the entry 22 and a second mail item sensor 35 is located adjacent the feed bed downstream of the input rollers 12, 21 to detect, at a predetermined location between the print head 26 and the input rollers, passage of a leading edge or a trailing edge of the mail item.

Figure 2:
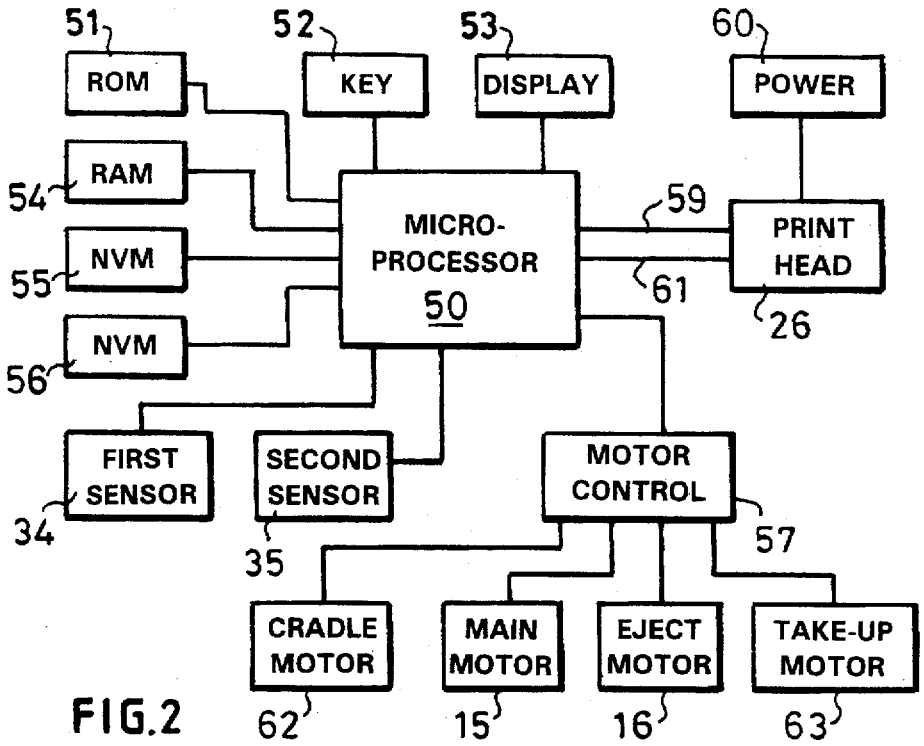
FIG. 2 is a block diagram of accounting and control circuits of the franking machine.

A thermal transfer ink ribbon is contained in a replaceable cassette 28. A supply of unused ribbon is wound on a supply spool 30. The unused ribbon 31 extends from the supply spool 30 out of the cassette to pass below the print head 26 and then the used ribbon 32 passes back into the cassette to be wound onto take-up spool 33 by operation of a take-up motor 63 (FIG. 2). The ribbon comprises a substrate or backing layer carrying a layer of ink which is transferable from the backing layer to an ink receiving medium. The ribbon is disposed such that the backing layer is adjacent the thermal printing elements of the print head and the ink layer faces the feed bed 11.

Referring now to FIG. 2, operation of the franking machine is effected by means of a micro-processor 50 operating under program routines stored in a read only memory (ROM) 51. As is well known in electronic franking machines, a keyboard 52 is provided for input of data by a user and a display 53 is provided to enable display of information to the user. A random access memory (RAM) 54 is provided for use as a working store for storage of temporary data during operation of the franking machine. Non-volatile duplicated memories 55, 56 are provided for the storage of data which is required to be retained even when the franking machine is not powered. Accounting data relating to use of the franking machine for printing franking impressions representing postage charges for mail items and any other critical data to be retained is stored in the non-volatile memories 55, 56. A motor controller 57 receives control signals from the microprocessor 50 to control operation of the motor 15 for driving the input drive roller and the impression roller, to control operation of motor 16 for driving the ejection roller, to control operation of a cradle motor 62 to raise and lower the impression roller and to control operation of take-up motor 63 to wind the used ink ribbon 32 onto the take-up spool. The first sensor 34 located at the entry 22 to the feed bed 11 and the second sensor 35 located downstream of the input rollers provide signals to the microprocessor to enable the microprocessor to control feeding of the mail item and energisation of the thermal print elements as the mail item is fed along past the print head.

Figure 3:
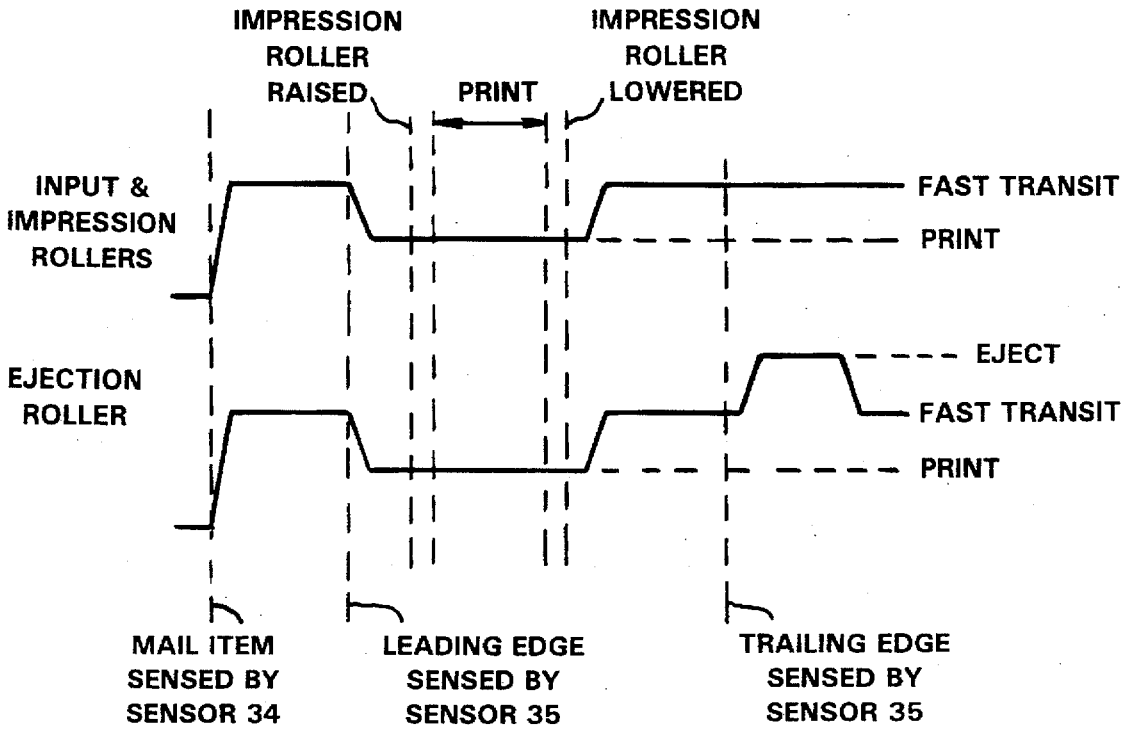
FIG. 3 is a timing chart illustrates the timing of operations in the franking machine.

When an edge of the item 20 is inserted into the entry 22, the first sensor 34 senses the presence of the mail item and sends a signal to the microprocessor to energise motors 15 and 16 so that as the leading edge of the mail item enters the nip between input rollers 12, 21, rotation of the input roller 12 by the motor 15 feeds the mail item along the feed bed toward the print head. As shown in FIG. 3 the motors 15 and 16 are energised such that the drive speed thereof is such that the peripheral speed of the rollers 12, 13 and 14 is at a fast transit speed so as to feed the mail item at the fast transit speed. Initially the impression roller is in its inoperative retracted position and the mail item is fed by the input rollers between the impression roller and the print head. The ribbon 31 extends between the mail item and the print head with the ink layer of the ribbon adjacent the mail item. The second sensor 35 senses when the leading edge of the mail item passes the predetermined location along the feed bed and the microprocessor, in response to a signal from the sensor 35, outputs a control signal to the motor controller 57 to reduce the drive speed of the motors 15, 16 to a lower drive speed such that the mail item is fed at a printing speed lower than the fast transit speed. At a predetermined time interval after the leading edge of the mail item is sensed by the sensor 35, the cradle motor 62 is energised to raise the impression roller to the operative position in which the impression roller is resiliently pressed against the lower surface of the mail item. As a result the mail item is pressed into ink transfer contact with the ink layer and the ribbon is pressed into heat transfer contact with the thermal printing elements of the print head 26. The ink layer of the ribbon adheres to the surface of the mail item and rotation of the impression roller by the motor 15 causes the thermal transfer ink ribbon to be drawn by the mail item past the thermal printing elements of the print head.

As the mail item is fed past the thermal printing elements of the print head by rotation of the impression roller 13, the microprocessor outputs, on line 59, to the print head 26 in each of a plurality of printing cycles signals selecting those ones of the printing elements which are to be energised in the respective cycle. A pulse of electrical power is supplied to the selected thermal printing elements from a power source 60 when a strobe signal is supplied by the microprocessor on line 61 to the print head.

During passage of the mail item together with the thermal transfer ink ribbon past the thermal printing elements, the selective energisation of the thermal printing elements effects heating of areas of the ink layer adjacent the energised elements and thereby causes those areas of the ink layer to adhere more strongly to the surface of the mail item than the remainder of the ink layer.

After passing the print head, the ribbon is peeled from the mail item leaving those areas of the ink layer which have been subjected to heating by energised ones of the printing elements adhered to the mail item. Thus by selectively energising the thermal printing elements in each of the series of printing cycles as the mail item and ribbon are fed past the thermal printing elements, areas of the ink layer are caused to adhere to the mail item to form a required printed impression on the mail item. The energisation of the thermal printing elements is controlled by the microprocessor 50, which carries out postage metering functions, to print a fixed invariable pattern of a franking impression together with variable data comprising the value of postage charge for the item and the date. In addition if desired the microprocessor may further control energisation of the thermal printing elements to print a slogan or other secondary print alongside the franking impression.

The ribbon is guided by guide rollers 34, 35 mounted in the cassette and disposed respectively upstream and downstream of the print head. Peeling of the used ribbon from the mail item is effected by torque applied to the take-up spool 33 by the take-up motor 63 to wind the used ribbon onto the take-up spool and to apply tension to the ribbon downstream of the thermal print elements.

Upon completion of printing of the required impression on the mail item, the microprocessor causes operation of the cradle motor to retract the impression roller from the operative position to the inoperative position. The microprocessor then controls energisation of the drive motors 15, 16 to increase the drive speed up to the fast transit speed. After the trailing edge of the mail item leaves the nip between the drive rollers 12, 21, the trailing edge of the mail item is detected by the second sensor 35 and the microprocessor increases the drive speed of motor 16 to drive the ejection rollers to feed the mail item out of the exit 25 from the franking machine at a fast ejection speed greater than the fast transit speed.

It is preferred that the motor 15 driving the input roller and the impression roller is a stepper motor, the drive speed thereof being determined by the rate at which drive pulses are supplied to the motor 15. Thus while the mail item is fed at the fast transit speed, drive pulses are applied by the motor controller 57 at a high first rate and while the mail item is fed at the printing speed drive pulses are supplied by the motor controller 57 at a second rate lower than the first rate. It is preferred that the motor 16 is a DC motor controlled by the motor controller 57 to drive at a selected one of three speeds, the speed being determined by magnitude of drive voltage supplied to the motor 16. At a normal drive voltage, for example 12 V, for the DC motor 16, the transmission means 19 drives the ejection roller 24 at a speed such that the peripheral speed of the ejection rollers matches the peripheral speed of the input and impression rollers when the latter are driven by the motor 15 at fast transit speed. When the input and impression rollers are driven by the motor 15 at printing speed the motor controller 57 applies a lower drive voltage, for example 5 V, to the DC motor 16. At this lower drive voltage, the motor 16 drives the ejection rollers such that the peripheral speed thereof is equal to or slightly greater than the printing speed of the impression roller. With this lower drive voltage applied to the motor 16, the motor 16 has a relatively low output torque. Hence if there is any mismatch between the printing speed of the impression roller and the peripheral speed of the ejection roller while the mail item is being fed by both the impression roller and the ejection rollers, drag will be applied by the mail item to the ejection rollers to reduce the speed of the ejection rollers to match the speed of the impression roller. The torque of the motor 16 when energised by the lower drive voltage is insufficient to cause any significant change to the print feed speed of the mail item as determined by the rotation of the impression roller. When the trailing edge of the mail item is detected by the second sensor 35, the trailing edge of the mail item is no longer gripped by the input rollers and the impression roller has been lowered so that the feeding of the mail item is solely by means of the ejection rollers. Accordingly the ejection rollers can be driven at the high ejection speed by the microprocessor controlling the motor controller 57 to supply a high voltage, for example 24 V, greater than the normal drive voltage to the motor 16. It will be appreciated that the high voltage is supplied to the motor 16 driving the ejection roller only when the mail item is not engaged by either the input rollers or the impression roller. After a predetermined interval, the voltage drive to the ejection motor 16 is reduced so as to reduce the drive speed of the ejection rollers down to the fast transit speed.

I claim:

1. A mail transport for a franking machine including a first input roller and a second input roller opposed to said first input roller; said first and second input rollers being rotatable to feed a mail item into the franking machine; a first ejection roller and a second ejection roller opposed to said first ejection roller; said first and second ejection rollers being rotatable to eject the mail item from the franking machine; a thermal print head located intermediate the input rollers and the ejection rollers; a rotatable impression roller located in opposition to said print head for pressing a mail item and thermal transfer ink ribbon into printing engagement with thermal printing elements of said thermal print head; first drive means operable to rotate the first input roller; second drive means operable to rotate the first ejection roller; control means operative in an input period in respect of said mail item to operate the first drive means to rotate the first input roller to feed the mail item at a transit speed to the print head; in a printing period in respect of said mail item during which period the mall item is engaged between the impression roller and the print head to operate the first drive means to rotate the first input roller to feed the mail item at a printing speed lower than said transit speed; in a first ejection period in respect of the mail item subsequent to completion of the printing period to operate the first drive means to rotate the first input roller to feed the mail item at the transit speed and to operate the second drive means to rotate the first ejection roller to feed the mail item at said transit speed and in a second ejection period in respect of the mail item subsequent to the mail item passing from the first and second input rollers to operate the second drive means to rotate the first ejection roller to feed the mail item at an ejection speed higher than said transit speed.

2. A mail transport as claimed in claim 1 wherein the first drive means is operable during the input period to rotate the impression roller to feed the mail item at the input speed and is operable during the printing period to rotate the impression roller to feed the mail item at the printing speed.

3. A mail transport as claimed in claim 1 wherein the control means includes first sensor means operative to sense passage of a leading edge of the mail item past a predetermined location upstream of the print head and wherein the control means is operative in response to said first sensor means sensing the leading edge of the mail item to control the first drive means to change from feeding the mail item at the transit speed to feeding the mail item at the printing speed.

4. A mail transport as claimed in claim 1 wherein the control means is operative in the printing period to operate the second means to rotate the first ejection roller to feed the mail item at the printing speed.

5. A mail transport as claimed in claim 4 wherein the control means is operative during the input period and during the first ejection period to operate the second drive means to rotate the first ejection roller to feed the mail item at the transit speed and during the printing period to feed the mail item at the printing speed.

6. A mail transport as claimed in claim 1 including second sensor means responsive to passage of a trailing edge of the mail item past a location downstream of the input rollers and wherein the control means is operative in response to said second sensor means sensing the trailing edge to control the second drive means to change rotation of the first ejection roller from feeding the mail item at the transit speed to feeding the mail item at the ejection speed.

7. A mail transport as claimed in claim 1 wherein the first drive means includes a stepper motor and wherein the rotation of the first input roller and of the impression roller is determined by the rate of drive pulses energising the stepper motor.

8. A mail transport as claimed in claim 1 wherein the second drive means includes a DC motor and wherein the speed of feeding of the mail item by the ejection rollers is controlled by magnitude of a DC potential energising the DC motor.

9. A mail transport for a franking machine including a first input roller and a second input roller opposed to said first input roller; said first and second input rollers being effective to engage a mail item therebetween and being rotatable to feed the mail item into the franking machine; a first ejection roller and a second ejection roller opposed to said first ejection roller; said first and second ejection rollers being effective to engage a mail item therebetween and being rotatable to eject the mail item from the franking machine; a thermal print head located intermediate the input rollers and the ejection rollers; a rotatable impression roller located in opposition to said print head for pressing a mail item and thermal transfer ink ribbon into printing engagement with thermal printing elements of said thermal print head; first drive means operable to rotate the first input roller; second drive means operable independently of said first drive means to rotate the first ejection roller; control means operative to operate the first drive means to drive the first input roller to feed the mail item at a transit speed in an input period and a first ejection period and to feed the mail item at a printing speed in a printing period during which the mail item is engaged between the impression roller and the print head and said control means being operative to operate the second drive means to drive the first ejection roller at the transit speed during the input period and the first ejection period, to drive the first ejection roller at the printing speed during the printing period and to drive the first ejection roller at an ejection speed higher than said transit speed during a second ejection period subsequent to said first ejection period.

10. A mail transport for a franking machine in which a mail item is fed into the machine past a print head to receive a franking impression in a printing period and is then ejected including an input roller; an ejection roller; said print head being located intermediate said input roller and said ejection roller; input and ejection idler rollers respectively opposed to said input and ejection rollers; said input roller being rotatable to feed the mail item to the print head and the ejection roller being rotatable to feed the mail item from the print head and control means operative to drive the input roller to feed the mail item toward the print head at a transit feed speed during an input period and subsequent to said input period during the printing period to feed the mail item past the print head at a printing speed lower than said transit speed; said control means being operative to drive the ejection roller to feed the mail item at the transit speed during the input period and at the printing speed during the printing period; said control means being operative to drive the input roller and the ejection roller at the transit speed during a first ejection period subsequent to the printing period and said control means in a second ejection period subsequent to the first ejection period and subsequent to a trailing edge of the mail item passing from engagement with the input roller being operative to drive the ejection roller to feed the mail item at an ejection speed higher than said transit speed.

* * * * *